US008448795B2

(12) United States Patent
Wagner et al.

(10) Patent No.: US 8,448,795 B2
(45) Date of Patent: May 28, 2013

(54) ARTICULATING PILOTS ON MODEL TRAINS

(75) Inventors: Tim Wagner, San Luis Obispo, CA (US); Yoo Chan Yang, Gainesville, VA (US)

(73) Assignee: Lionel L.L.C., Chesterfield, MI (US)

( * ) Notice: Subject to any disclaimer, the term of this patent is extended or adjusted under 35 U.S.C. 154(b) by 322 days.

(21) Appl. No.: 12/761,298

(22) Filed: Apr. 15, 2010

(65) Prior Publication Data

US 2011/0253001 A1 Oct. 20, 2011

(51) Int. Cl.
*A63H 19/18* (2006.01)

(52) U.S. Cl.
USPC ..... 213/75 TC; 105/1.5

(58) Field of Classification Search
USPC ..... 105/1.5, 157.2; 213/75 TC; 446/467
See application file for complete search history.

(56) References Cited

U.S. PATENT DOCUMENTS 4,450,772 A 5/1984 Van Sickle
5,316,158 A * 5/1994 Dunham et al. ..... 213/75 TC
6,910,424 B2 6/2005 Ruocchio et al.

* cited by examiner

*Primary Examiner* — Mark Le
(74) *Attorney, Agent, or Firm* — O'Melveny & Myers LLP

(57) ABSTRACT

A system and method is provided for pivoting a pilot on a model train, thereby allowing the model train to maneuver around a section of a model train track having a relatively small radius. In one embodiment of the present invention, the model train includes a frame, a shell connected to the frame, at least one truck assembly, at least one pilot and at least one coupler, wherein the coupler includes a coupler assembly and a coupler arm. The pilot is connected to a pilot arm, and the pilot arm, the coupler arm and the truck assembly are pivotally attached to the frame (e.g., via common or different pivots). In another embodiment of the present invention, the model train shell includes an aperture configured to receive a pilot arm. The pilot arm is connected to the pilot, which includes an aperture adapted to receive a coupler arm. The shell aperture is sized to allow the pilot arm to pivot from side to side, and the pilot aperture is sized to allow the coupler arm to pivot from side to side. By allowing the pilot to horizontally pivot, a model train track can be constructed using tighter curves, or curves with smaller radii.

20 Claims, 8 Drawing Sheets

ARTICULATING PILOTS ON MODEL TRAINS

BACKGROUND OF THE INVENTION

1. Field of the Invention

The present invention relates to model trains, or more particularly, to a system and method for pivoting a pilot on a model train, thereby allowing the model train to maneuver around a model train track portion having a relatively small radius.

2. Description of Related Art

For model train enthusiasts, it is an objective of a model train to closely resemble an actual train. For example, as shown in shown in FIG. 1, the model train may include a cab 104, a smoke stack 102, a pilot 106, a truck (or wheel) assembly (e.g., 134) and a coupler (e.g., 150). It is also an objective, however, for the train to function as an actual train. For example, the model train may be configured to move around a model train track, produce smoke or steam and generate train sounds (e.g., whistles, bells, horns, "chuffs," etc.). However, these two objectives are not necessarily mutually exclusive. For example, in designing a model train that closely resembles an actual train, the model train may include structure that prevents the model train from properly moving around a model train track.

For example, as shown in FIG. 1, a model train may include a frame 120, a shell 100, a plurality of truck (or wheel) assemblies 130, 134, 136, a rear coupler 140 and a front coupler 150, wherein the rear coupler includes a rear coupler assembly 144 and a rear coupler arm 146, the front coupler 150 includes a front coupler assembly 154 and a front coupler arm 152, and the shell 100 includes features that closely resemble an actual train. The features may include, for example, a cab 104, a smoke stack 102 and a pilot (or scoop) 106. The front coupler assembly 154 is configured to mate (or link) with a corresponding rear coupler assembly on an adjacent model train. See, e.g., FIG. 2*b*. As can be seen in FIG. 2*a*, the front coupler assembly 154 is connected to the front coupler arm 152, which is pivotally connected to the frame 120 at pivot 156. As shown in FIG. 3, the front coupler arm 152 is disposed through an aperture 306 in the pilot 106. The aperture 306 is large enough so that the coupler arm 152 can pivot horizontally (i.e., left and right) as the model train travels around the model train track. See, e.g., FIG. 8.

While such a configuration may be advantageous in that it resembles an actual train, it can actually interfere with the train's ability to maneuver around a model train track, especially if the track includes a curve with a relatively small radius. This is because the front coupler arm 152 can only pivot so far before it comes into contact with the pilot 106, or the edge of the aperture 306, which is fixed relative to the frame 120. If the curve in the model train track is such that it requires the front coupler arm 152 to pivot past the edge of the aperture 306, then the model train may likely derail. While this is not an issue with real trains, since real train tracks include curves having large radii, it can be an issue with model trains. This is because model train tracks are generally assembled in small, confined spaces (e.g., in a basement, around a Christmas tree, etc.), thereby requiring at least one curve with a relatively small radius.

Thus, it would be advantageous to provide a model train that can successfully travel over a model train track portion having a relatively small radius. Such a train may include, for example, a pilot configured to pivot if the coupler, which is also configured to pivot, comes into contact with the pilot.

SUMMARY OF THE INVENTION

The present invention provides a system and method for pivoting a pilot on a model train, thereby allowing the model train to maneuver around a section of a model train track having a relatively small radius. Preferred embodiments of the present invention operate in accordance with either a model train or a model train system comprising a first model train, a second model train and/or a model train track.

In one embodiment of the present invention, the model train includes a frame, a shell connected to the frame, at least one truck assembly, at least one pilot (e.g., a scoop, skirt, etc.) and at least one coupler, wherein the coupler includes a coupler assembly and a coupler arm. The pilot is connected to a pilot arm, and the pilot arm, the coupler arm and the truck assembly are pivotally connected to the frame via at least one pivot. In one embodiment of the present invention, a single pivot is used to connect the pilot arm, the coupler arm and the truck assembly to the frame. In alternate embodiments of the present invention, at least two pivots are used to connect the pilot arm, the coupler arm and the truck assembly to the frame.

In another embodiment of the present invention, the model train shell includes a front portion, which includes an aperture adapted to receive a pilot arm. The pilot arm is connected to the pilot, which includes an aperture adapted to receive a coupler arm. The aperture in the front portion of the shell is sized to allow the pilot arm to pivot from side to side, and the aperture in the pilot is sized to allow the coupler arm to pivot from side to side.

By allowing the pilot to pivot, a model train track can be constructed using tighter curves, or curves with smaller radii. For example, when a model train is moving on a straight section of a track, the pilot, the pilot arm, the coupler assembly, and the coupler arm are (generally) centered about a horizontal center of the model train. When the train (or adjacent train) travels over a curved section of the track, the coupler arm pivots (or rotates) away from the horizontal center of the train. At a distance (D), the coupler arm comes into contact with the pilot, or a side of the aperture of the pilot, and can no longer pivot (or rotate) in that direction. At this point, due to pressure exerted by the coupler arm, the pilot pivots (or rotates) away from the horizontal center of the train. By allowing the pilot to pivot, the model train can be maneuver around tighter curves on a model train track.

In another embodiment of the present invention, the pilot, the coupler and/or the truck assembly are used together with at least one spring, or at least one spring-like device. The spring (or spring-like device) can used to bias a corresponding pivot toward its original (or starting) position. For example, the spring may be used to bias the pilot or coupler toward the horizontal center of the model train. In one embodiment of the present invention, the spring for the pilot is more resilient than the spring for the coupler. This can result in the pilot returning to its original position before the coupler returns to its original position.

A more complete understanding of a system and method for pivoting a pilot on a model train will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a system and method for pivoting a pilot on a model train, thereby allowing the model train to maneuver around a section of a model train track having a relatively small radius. In the detailed description that follows, like element numerals are used to describe like elements illustrated in one or more figures.

As previously discussed, one objective of a model train is to closely resemble an actual train. For example, as shown in shown in FIG. 1, the model train may include a cab 104, a smoke stack 102, a pilot 106, a truck assembly (e.g., 134) and a coupler (e.g., 150). Another objective, however, is for the train to function as an actual train. For example, the model train may be configured to move around a model train track, produce smoke or steam and generate train sounds. However, these two objectives are not necessarily mutually exclusive. For example, in designing a model train that closely resembles an actual train, the model train may include structure that prevents the model train from properly moving around a model train track.

Figure 1:
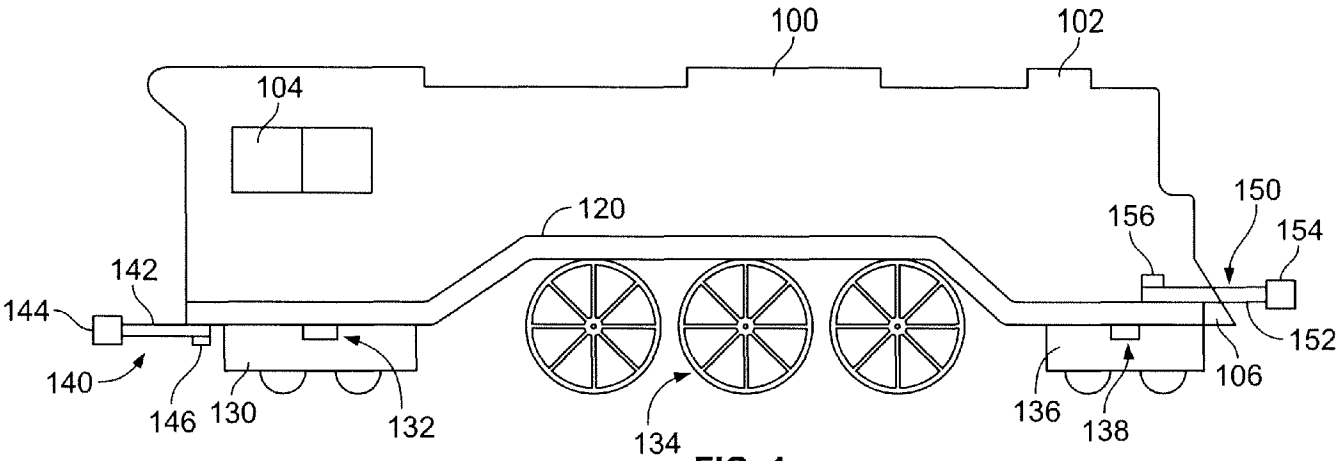
FIG. 1 (Prior Art)
FIG. 1 illustrates a side view of a prior art model train, including a shell, a frame, a plurality of truck assemblies, and a plurality of couplers.

For example, as shown in FIG. 1, a model train may include a frame 120, a shell 100, a plurality of truck assemblies 130, 134, 136, a rear coupler 140 and a front coupler 150, wherein the rear coupler includes a rear coupler assembly 144 and a rear coupler arm 142, the front coupler 150 includes a front coupler assembly 154 and a front coupler arm 152, and the shell 100 includes features that closely resemble an actual train. The features may include, for example, a cab 104, a smoke stack 102 and a pilot 106. The front coupler assembly 154 is configured to mate with a corresponding rear coupler assembly on an adjacent model train car.

Figure 2A:
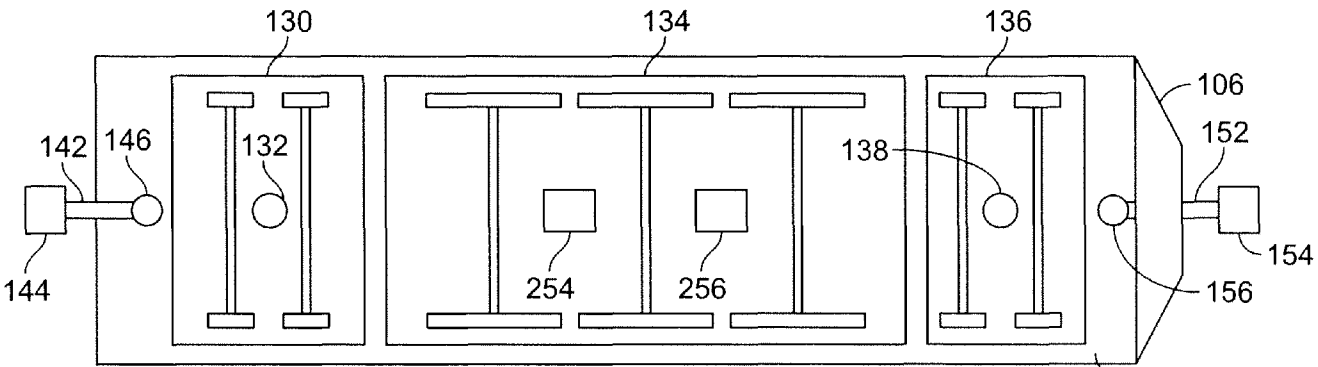
FIG. 2a (Prior Art)
FIG. 2*a* illustrates a bottom view of the prior art model train depicted in FIG. 1.
Figure 2B:
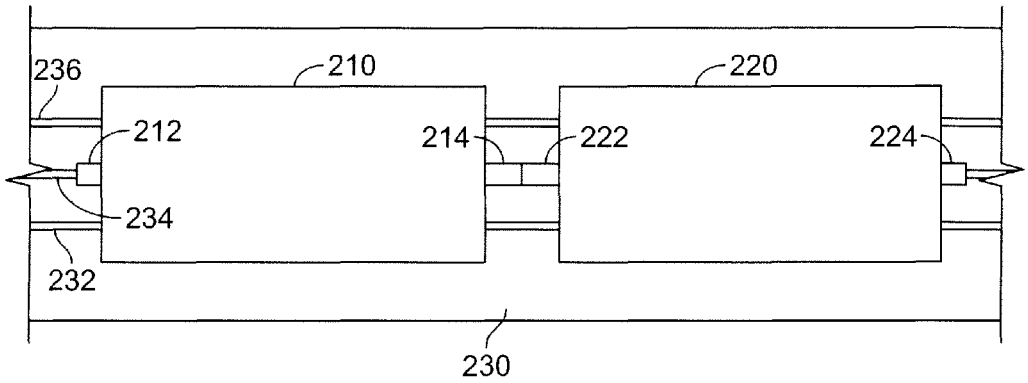
FIG. 2b (Prior Art)
FIG. 2*b* illustrates a top view of a prior art model train system, including a plurality of model trains and a model train track.

For example, as shown in FIG. 2*b*, a front coupler 214 of a first model train 210 is configured to mate with a rear coupler 222 of a second model train 220. Both trains are further configured to move over a model train track 230, including a first outer rail 232, a second outer rail 236 and a center rail 234. As shown in FIG. 2*a*, each truck assembly 130, 134 and 136 includes at least two wheels that are coupled together via an axel and configured to roll on the first and second outer rails 232, 236. The model train further includes at least one spring-loaded roller 254, 256 that is configured to roll on the center rail 234. In a traditional model train system, a positive potential is provided (or electrically conducted) to the model train via the center rail 234 and the spring-loaded roller 254, 256, and ground (or a less-positive potential) is provided to the model train via at least one of the two outer rails 232, 236 and at least one wheel of the truck assembly 130, 134 and 136.

Figure 3:
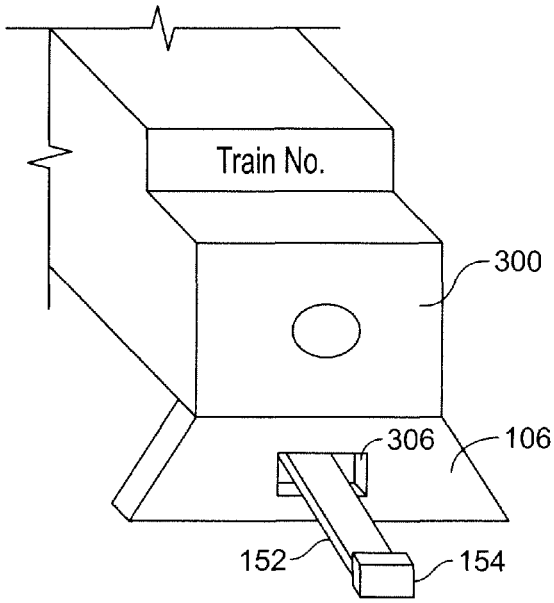
FIG. 3 (Prior Art)
FIG. 3 illustrates a front, perspective view of the prior art model train depicted in FIG. 1.

As can be seen in FIG. 2*a*, the front coupler assembly 154 is connected to the front coupler arm 152, which is pivotally connected to the frame 120 at pivot 156. As shown in FIG. 3, the front coupler arm 152 is disposed through an aperture 306 in the pilot 106. The aperture 306 is large enough so that the coupler arm 152 can pivot horizontally (i.e., left and right) as the model train travels around the model train track.

While a pilot with an aperture may be advantageous in that it resembles an actual train, the aperture can actually interfere with the train's ability to maneuver around a model train track, especially if the track includes a curve with a relatively small radius. This is because the front coupler arm 152 can only pivot so far before it comes into contact with the pilot 106, or the edge of the aperture 306, which is fixed relative to the frame 120. If the curve in the model train track is such that it requires the front coupler arm 152 to pivot past the edge of the aperture 306, then the model train may likely derail. While this is not an issue with real trains, since real train tracks include curves having large radii, it can be an issue with model trains. This is because model train tracks are generally assembled in small, confined spaces, thereby requiring at least one curve with a relatively small radius.

Figure 4:
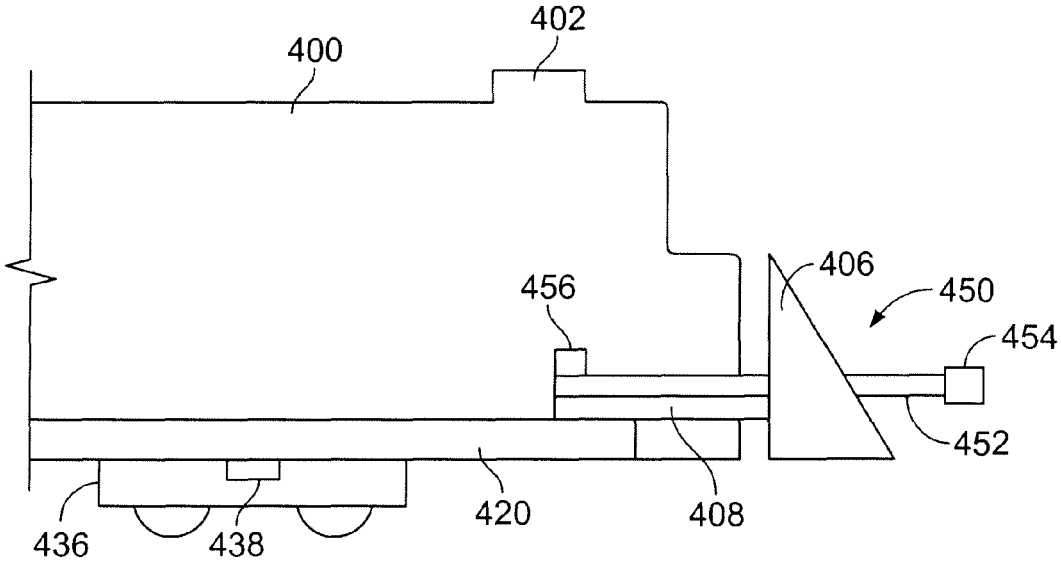
FIG. 4 illustrates, in accordance with one embodiment of the present invention a side view of a model train portion, including a shell, a frame, a pilot, a truck assembly and a coupler assembly.
Figure 6:
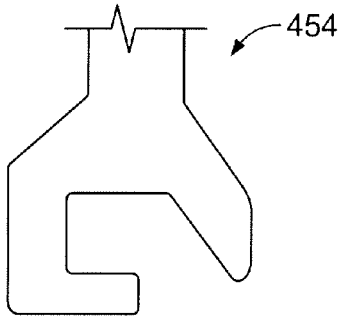
FIG. 6 illustrates, in accordance with one embodiment of the present invention, an exemplary coupler assembly.

The present invention addresses this issue by providing a model train with a pilot that can pivot horizontally (i.e., side to side), thereby allowing a model train to travel over a section of a model train track having a relatively small radius. A model train in accordance with one embodiment of the present invention is shown in FIG. 4. Specifically, the model train includes a frame 420, a shell 400 connected to the frame 420, at least one truck assembly 436, at least one pilot 406 and at least one coupler 450, wherein the coupler 450 includes a coupler assembly 454 and a coupler arm 452. As shown in FIG. 4, the pilot 406 is connected to a pilot arm 408, the pilot and coupler arms 408, 452 are pivotally attached to the frame via pivot 456, and the truck assembly 436 is pivotally attached to the frame via pivot 438. An exemplary coupler assembly is provided in FIG. 6. It should be appreciated, however, that the present invention is not limited to any particular type of coupler assembly, and includes, for example, all types of coupler and drawbar assemblies generally known to those skilled in the art. It should further be appreciated that the present invention is not limited to any particular type of pilot, and includes all types of pilots (e.g., scoops, skirts, etc.) generally known to those skilled in the art and/or commonly found on actual trains.

Figure 5:
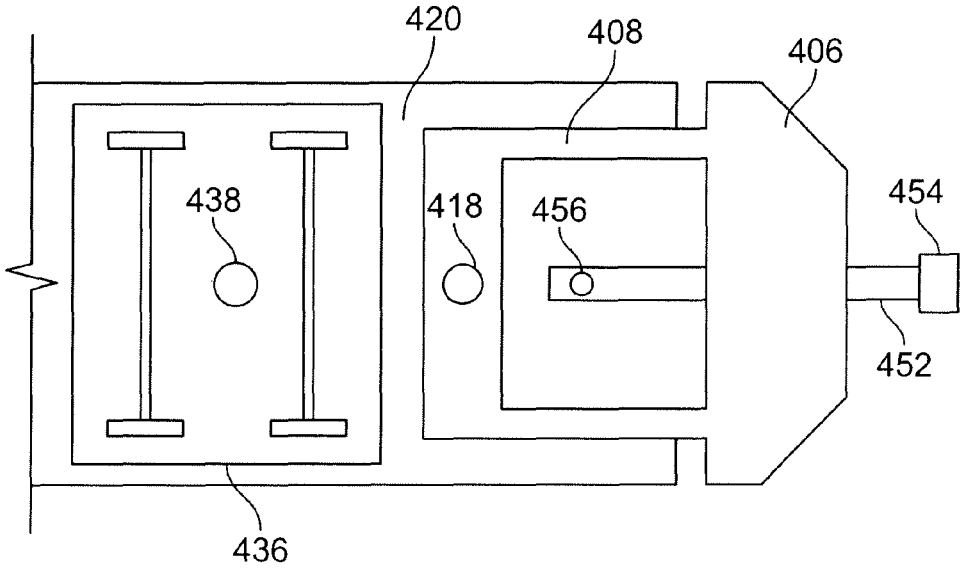
FIG. 5 illustrates, in accordance with another embodiment of the present invention, a bottom view of a model train portion, including a frame, a truck assembly and a coupler assembly.
Figure 10A:
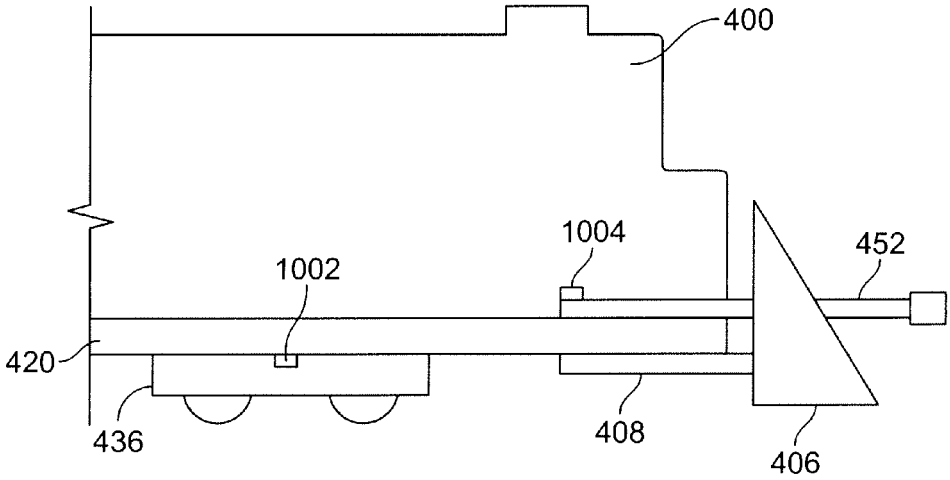
FIGS. 10*a-d* illustrate, in accordance with different embodiments of the present invention, side views of model train portions, including a frame, a truck assembly pivotally attached to the frame, a coupler pivotally attached to the frame and a pilot pivotally attached to the frame.
Figure 10B:
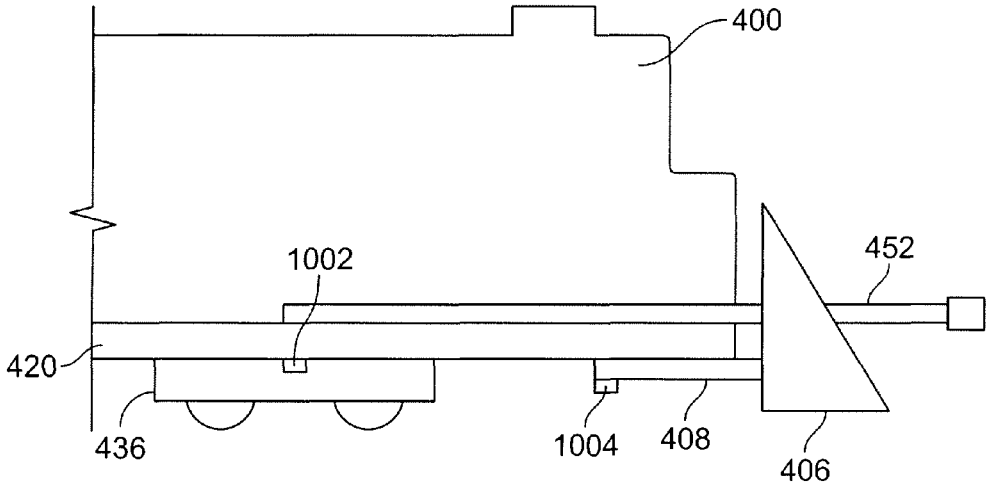
Figure 10C:
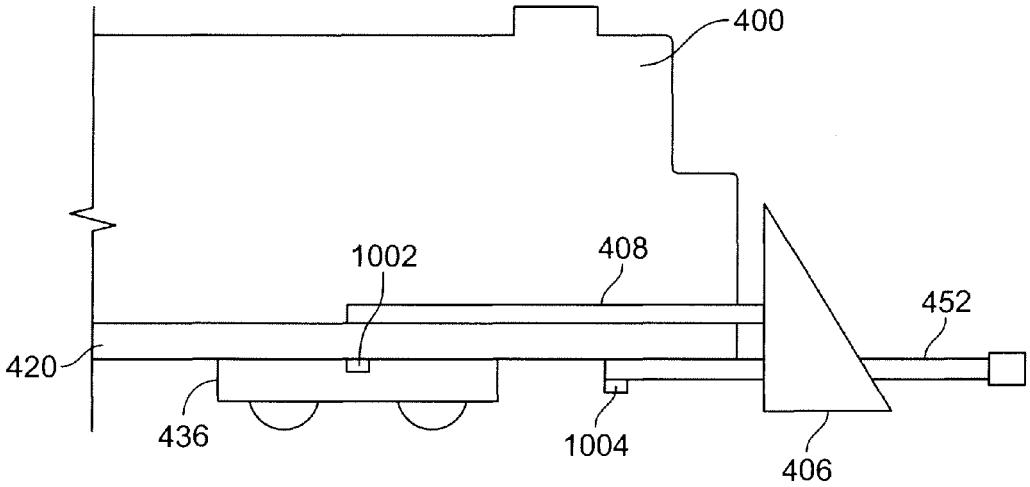
Figure 10D:
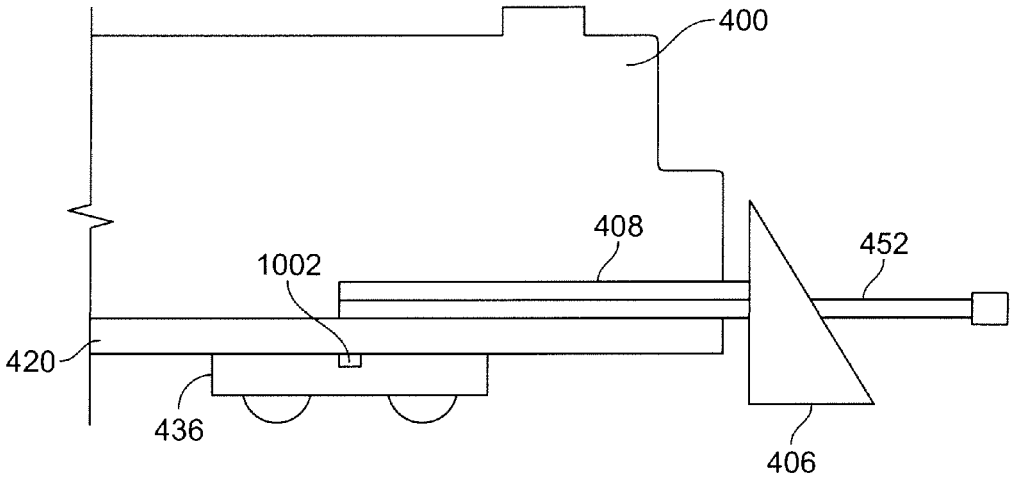

An alternate embodiment of the present invention is shown in FIG. 5. Therein, the truck assembly 436, the coupler arm 452 and the pivot arm 408 are connected to the frame 420 via three distinct pivots (i.e., 438, 456 and 418). It should be appreciated, however, that the present invention is not limited to any particular type of pilot arm, any particular type of coupler arm, or any particular method of connecting the pilot arm, the coupler arm or the truck assembly to the frame. For example, a model train comprising a first pivot 1002 for connecting the truck assembly to the frame (see FIG. 10*a*), the truck assembly and the coupler arm to the frame (see FIG. 10*b*), the truck assembly and the pilot arm to the frame (see FIG. 10*c*), or the truck assembly, pilot arm and coupler arm to the frame (see FIG. 10*d*), is within the spirit and scope of the present invention. Further a model train comprising a second pivot 1004 for connecting the coupler arm and the pivot arm to the frame (see FIG. 10*a*), the pivot arm to the frame (see FIG. 10*b*), or the coupler arm to the frame (see FIG. 10*c*), is within the spirit and scope of the present invention. It should be appreciated, however, that in embodiments of the present invention where a single pivot is used to connect the pilot and coupler arms to the frame, the coupler arm should be configured to pivot independent from the pilot arm. This is because the pilot arm is only configured, as least in preferred embodiments of the present invention, to pivot if the coupler arm comes into contact with the pilot, or a side of the aperture in the pilot.

As shown in FIG. 3, a traditional model train shell includes a front portion 300, which may include, for example, identifying information about the train (e.g., train no., etc.), a light and a pilot 106. The pilot 106, which is fixed to a frame, may further include an aperture 306. As shown in FIGS. 2*a* and 3, a first end of a coupler arm 152 is connected to a coupler assembly 154, and a second end of the coupler arm 152 is pivotally connected to the frame via pivot 156. The aperture 306 is generally sized large enough so that the coupler arm can pivot from side to side, but small enough so that the pilot resembles an actual pilot on an actual train.

Figure 7:
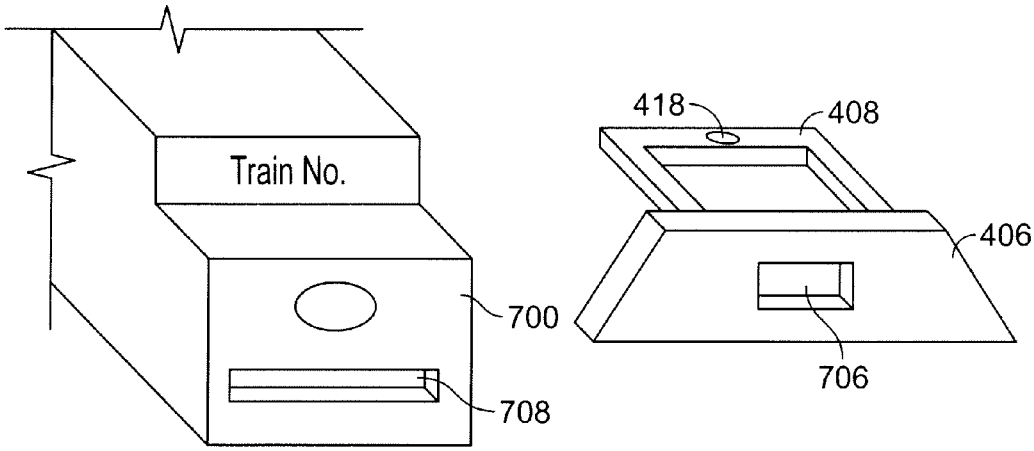
FIG. 7 illustrates, in accordance with one embodiment of the present invention, a front, perspective view of a model train portion, including a shell having an aperture and a pilot having an aperture.

A front portion of a model train in accordance with one embodiment of the present invention is shown in FIG. 7. Specifically, the front portion 700 includes an aperture adapted to receive a pilot arm 408. The pilot arm 408 is connected to the pilot 406, which includes an aperture adapted to receive a coupler arm. The aperture 708 in the front portion of the shell 700 is sized to allow the pilot arm to pivot from side to side (i.e., via pivot 418), and the aperture 706 in the pilot 406 is sized to allow the coupler arm to pivot from side to side. It should be appreciated, however, that the present invention is not limited to a model train in which the coupler arm passes through the pilot (i.e., via a first aperture) and/or the pilot arm passes through the shell (i.e., via a second aperture). For example, a model train in which the pilot arm passes under the front portion of the shell is within the spirit and scope of the present invention. Similarly, a model train in which the coupler arm passes under or over the pilot is also within the spirit and scope of the present invention.

Figure 8:
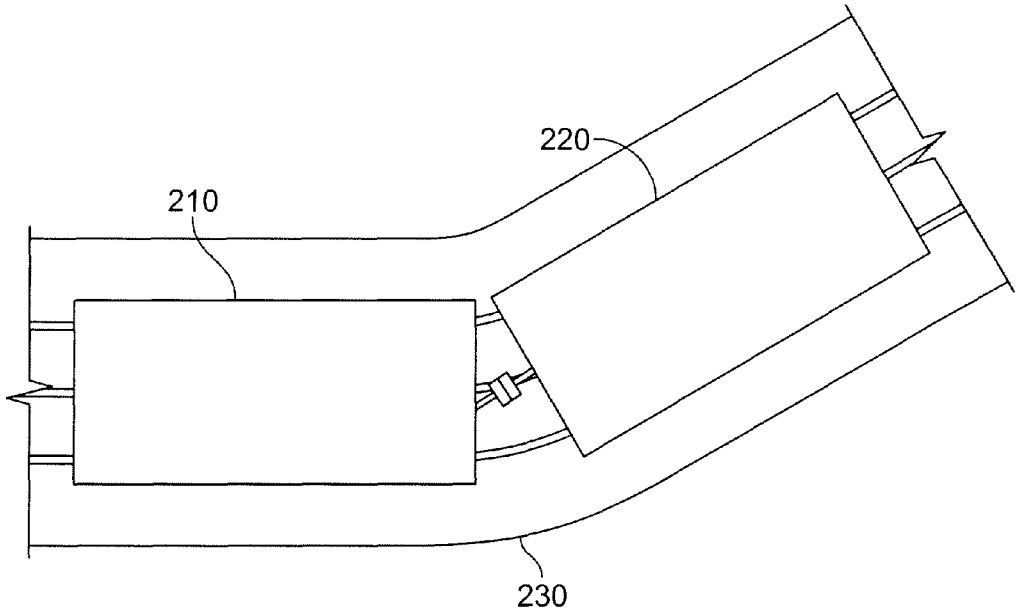
FIG. 8 illustrates, in accordance with one embodiment of the present invention, a top view of a model train system, including a plurality model trains and a model train track.
Figure 9A:
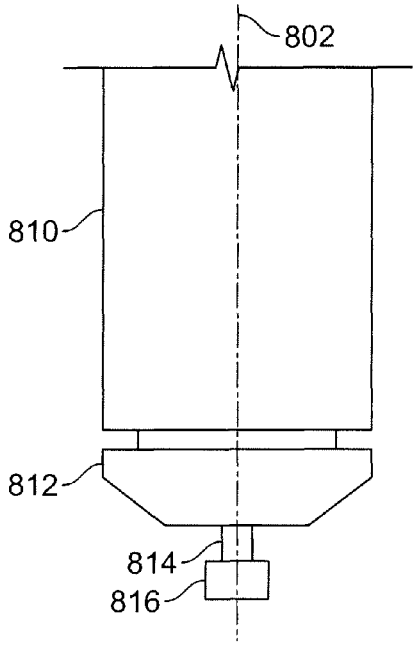
FIGS. 9*a-c* illustrate, in accordance with one embodiment of the present invention, top views of a model train portion, including a coupler in an original (or starting) position, a coupler arm in an angled (or pivotal) position, a pilot in an original (or starting) position, and a pilot in an angled (or pivotal) position.
Figure 9B:
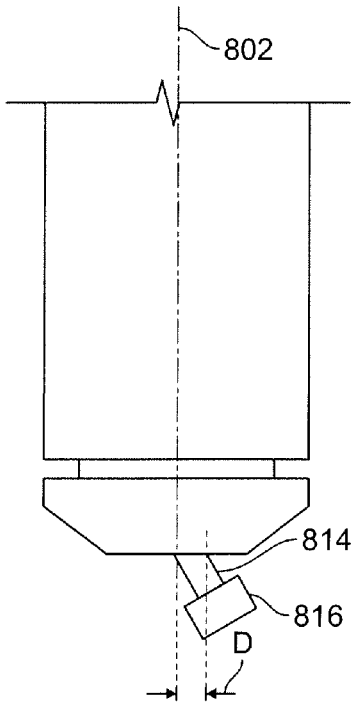
Figure 9C:
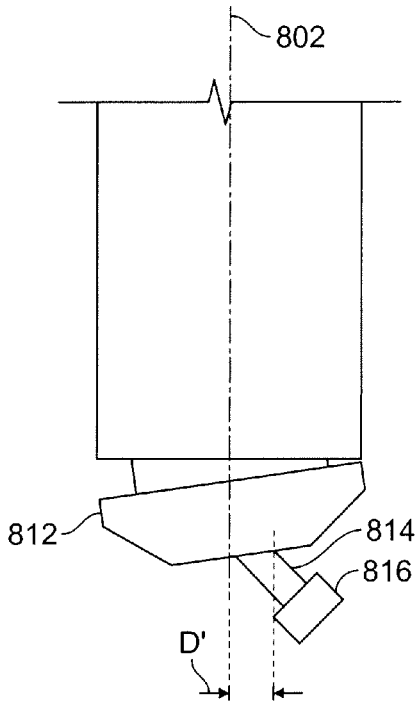

By allowing the pilot to horizontally pivot, a model train track can be constructed using tighter curves, or curves with smaller radii. For example, FIG. 8 illustrates that when a first train 220 is traveling over a curve section of a model train track 230, the coupler of the second train 210 starts to pivot (or rotate) to an angle (or distance) relative to a horizontal center of the train. This is illustrated in FIGS. 9*a-c*, wherein the model train includes a shell 810, a pilot 812, a coupler arm 814 and a coupler assembly 816. As shown in FIG. 9*a*, when the train is moving on a straight section of the track, the pilot 812, the coupler arm 814 and the coupler assembly 816 are (generally) centered about the horizontal center of the model train 802. As shown in FIG. 9*b*, when the train (or adjacent train) travels over a curved section of the track, the coupler arm 814 pivots (or rotates) away from the horizontal center 802. At distance (D), the coupler arm 814 comes into contact with the pilot 814, or a side of the aperture, and can no longer pivot (or rotate) in that direction. At this point, due to pressure exerted by the coupler arm 814, the pilot 812 pivots (or rotates) away from the horizontal center 802. This is shown in FIG. 9C. By pivoting the pilot 814 away from the horizontal center 802, the coupler arm 814 is pivoted even farther away from the horizontal center, e.g., to a distance (D'), which is greater than distance (D) in FIG. 9B. By allowing the pilot 812 to pivot, the model train can be maneuver around tighter curves on a model train track.

Figure 11:
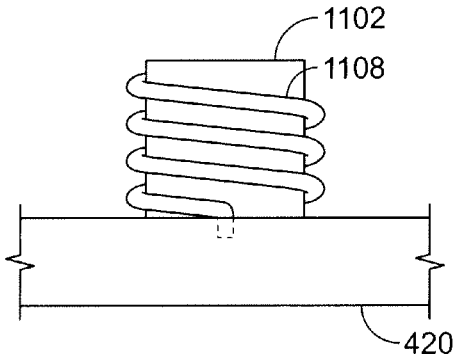
FIG. 11 illustrates, in accordance with one embodiment of the present invention, a side view of a frame, a pivot and a corresponding spring, which can be used to bias the pivot toward an original (or starting) position.

As shown in FIG. 11, the pivot 1102 of the pilot, coupler or truck assembly may be used in conjunction with a spring 1108. In this embodiment of the present invention, the spring 1108 is used to bias the pivot 1102 toward its original (or starting) position. For example, the spring 1108 may be used to bias the pilot or coupler toward the horizontal center of the model train. In one embodiment of the present invention, the spring for the pilot is more resilient than the spring for the coupler. Under certain circumstances, this can result in the pilot returning to its original position before the coupler returns to its original position. It should be appreciated, however, that the present invention is not limited to a traditional coil spring(s) for biasing the pilot (or coupler) toward the horizontal center of the model train, and that other spring-like devices can be used to perform the same function.

Figure 5A:
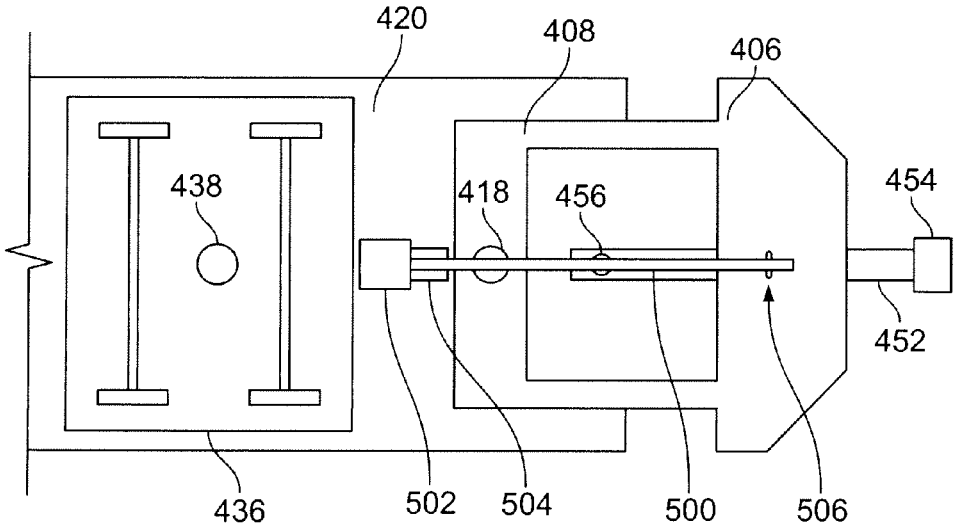
FIG. 5*a* illustrates, in accordance with another embodiment of the present invention, a bottom view of a model train portion, including a frame, a pilot and a spring-like device connected to both the frame and the pilot.

For example, as shown in FIG. 5*a*, the model train may include a rod 500 (e.g., a metal rod, a plastic rod, an elongated resilient structure, etc.) having a first end connected to the frame 420 via a first point 502 (e.g., a rod source) and a second end connected to the pilot 406 via a second point 506 (e.g., a rod fastener). The resiliency of the rod 500 functions to bias the pilot 406 toward the horizontal center of the model train. If additional resiliency is required, a stabilizer 504 can added to the model train (e.g., connected between the frame 420 and the rod 505, connected to the frame 420 at a location adjacent to the rod 500, etc.). The purpose of the stabilizer 504 is to prevent movement (e.g., in a horizontal direction) of a first portion of the rod (i.e., between the stabilizer and the first point), thereby increasing resiliency in a second portion of the rod (i.e., between the stabilizer and the second point). By moving the stabilizer 504 toward the second point 506, the second portion of the rod 500 becomes shorter, and therefore more resilient. It should be appreciated that the present invention is not limited to the use of a stabilizer to prevent movement in the first portion of the rod, but may also be used to limit movement in the first portion of the rod. For example, a stabilizer that allows the first portion of the rod to move a predetermined distance in the horizontal direction, but prevents movement beyond the predetermined distance, is within the spirit and scope of the present invention.

Having thus described several embodiments of a system and method for pivoting a pilot on a model train, it should be apparent to those skilled in the art that certain advantages of the system and method have been achieved. It should also be appreciated that various modifications, adaptations, and alternative embodiments thereof may be made within the scope and spirit of the present invention. For example, the pilot may be pivotally attached to the frame, and the coupler may be pivotally attached to either the frame or the pilot. The invention is solely defined by the following claims.

What is claimed is:

1. A model train, comprising:

a shell configured to resemble an exterior of an actual train;

a frame connected to said shell;

at least one truck assembly pivotally attached to said frame, said at least one truck assembly comprising at least two wheels configured to roll on a model train track;

a pilot comprising a pilot assembly and a pilot arm, wherein said pilot assembly includes an aperture, is connected to said pilot arm, and is configured to resemble an actual pilot on said actual train, said pilot arm being attached via a first pivot to said frame; and a coupler comprising a coupler assembly and a coupler arm, wherein said coupler assembly is connected to said coupler arm and is configured to link said model train to an adjacent model train via a corresponding coupler arm on said adjacent model train, said coupler arm being routed through said aperture and attached via a second pivot to said frame;

wherein said coupler arm is configured to horizontally pivot on said second pivot in response to at least movement of said adjacent model train over a curved portion of said model train track, and said pilot arm is configured to horizontally pivot on said first pivot in response to said coupler arm coming into contact with a side of said aperture; and wherein said shell comprises an aperture, and said pilot arm is routed through said aperture of said shell and attached via said second pivot to said frame.

2. The model train of claim 1, further comprising a first spring connected to said first pivot, said first spring being configured to bias said pilot arm toward a horizontal center of said model train.

3. The model train of claim 2, further comprising a second spring connected to said second pivot, said second spring being configured to bias said coupler arm toward a horizontal center of said aperture.

4. The model train of claim 1, further comprising a second spring connected to said second pivot, said second spring being configured to bias said coupler arm toward a horizontal center of said aperture.

5. A model train, comprising:

a shell configured to resemble an exterior of an actual train;

a frame connected to said shell;

at least one truck assembly pivotally attached to said frame, said at least one truck assembly comprising at least two wheels configured to roll on a model train track;

a pilot comprising a pilot assembly and a pilot arm, wherein said pilot assembly includes an aperture, is connected to said pilot arm, and is configured to resemble an actual pilot on said actual train, said pilot arm being attached via a first pivot to said frame; and a coupler comprising a coupler assembly and a coupler arm, wherein said coupler assembly is connected to said coupler arm and is configured to link said model train to an adjacent model train via a corresponding coupler arm on said adjacent model train, said coupler arm being routed through said aperture and attached via a second pivot to said frame;

wherein said coupler arm is configured to horizontally pivot on said second pivot in response to at least movement of said adjacent model train over a curved portion of said model train track, and said pilot arm is configured to horizontally pivot on said first pivot in response to said coupler arm coming into contact with a side of said aperture; and wherein said at least one truck assembly is attached to said frame via said first pivot.

6. A model train, comprising:

a shell configured to resemble an exterior of an actual train;

a frame connected to said shell;

at least one truck assembly pivotally attached to said frame, said at least one truck assembly comprising at least two wheels configured to roll on a model train track;

a pilot comprising a pilot assembly and a pilot arm, wherein said pilot assembly includes an aperture, is connected to said pilot arm, and is configured to resemble an actual pilot on said actual train, said pilot arm being attached via a first pivot to said frame; and a coupler comprising a coupler assembly and a coupler arm, wherein said coupler assembly is connected to said coupler arm and is configured to link said model train to an adjacent model train via a corresponding coupler arm on said adjacent model train, said coupler arm being routed through said aperture and attached via a second pivot to said frame;

wherein said coupler arm is configured to horizontally pivot on said second pivot in response to at least movement of said adjacent model train over a curved portion of said model train track, and said pilot arm is configured to horizontally pivot on said first pivot in response to said coupler arm coming into contact with a side of said aperture; and wherein said at least one truck assembly is attached to said frame via said second pivot.

7. A model train, comprising:

a shell configured to resemble an exterior of an actual train;

a frame connected to said shell;

at least one truck assembly pivotally attached to said frame, said at least one truck assembly comprising at least two wheels configured to roll on a model train track;

a pilot comprising a pilot assembly and a pilot arm, wherein said pilot assembly includes an aperture, is connected to said pilot arm, and is configured to resemble an actual pilot on said actual train, said pilot arm being attached via a first pivot to said frame;

a coupler comprising a coupler assembly and a coupler arm, wherein said coupler assembly is connected to said coupler arm and is configured to link said model train to an adjacent model train via a corresponding coupler arm on said adjacent model train, said coupler arm being routed through said aperture and attached via a second pivot to said frame;

a first spring connected to said first pivot, said first spring being configured to bias said pilot arm toward a horizontal center of said model train; and a second spring connected to said second pivot, said second spring being configured to bias said coupler arm toward a horizontal center of said aperture;

wherein said coupler arm is configured to horizontally pivot on said second pivot in response to at least movement of said adjacent model train over a curved portion of said model train track, and said pilot arm is configured to horizontally pivot on said first pivot in response to said coupler arm coming into contact with a side of said aperture; and wherein said first spring is more resilient than said second spring, thereby allowing said pilot assembly to reach said horizontal center of said model train before said coupler arm reaches said horizontal center of said aperture.

8. The model train of claim 7, further comprising a rod connected at a first end to said frame and at a second end to said pilot assembly, said rod being configured to bias said pilot assembly toward a horizontal center of said model train.

9. The mode train of claim 8, further comprising a stabilizer connected to said frame and at least adjacent to said rod, said stabilizer being configured to increase the resiliency of said rod relative to said pilot assembly.

10. A model train system, comprising:

a model train track;

a first model train configured to roll on said model train track, said first model train comprising a first coupler; and a second model train comprising:

a shell;

a frame connected to said shell;

at least one truck assembly pivotally attached to said frame, said at least one truck assembly comprising at least two wheels configured to roll on said model train track;

a pilot comprising a pilot assembly and a pilot arm, wherein said pilot assembly includes an aperture and is connected to said pilot arm, said pilot arm being pivotally attached to said frame; and a second coupler comprising a coupler assembly and a coupler arm, wherein said coupler assembly is connected to said coupler arm and is configured to link said second model train to said first model train via said first coupler, said coupler arm being positioned through said aperture of said pilot assembly and pivotally attached to said frame, thereby allowing said coupler arm to pivot horizontally a predetermined distance without coming into contact with a side of said aperture;

wherein said coupler arm is configured to pivot horizontally in response to at least said first model train moving over a curved portion of said model train track, and said pilot arm is configured to pivot in response to said coupler arm pivoting horizontally beyond said predetermined distance; and wherein said shell comprises an aperture, and said pilot arm is routed through said aperture of said shell and pivotally attached to said frame.

11. The model train of claim 10, wherein said at least one truck assembly is attached to said frame via a first pivot and said pilot arm and said coupler arm are attached to said frame via a second pivot.

12. The model train of claim 10, further comprising a first spring configured to bias said pilot arm toward a horizontal center of said model train.

13. The model train of claim 12, further comprising a second spring configured to bias said coupler arm toward a center of said aperture.

14. The model train of claim 10, further comprising a second spring configured to bias said coupler arm toward a center of said aperture.

15. The model train of claim 10, further comprising an elongated resilient structure connected at a first end to said frame and at a second end to said pilot assembly, said elongated resilient structure being configured to bias at least said pilot arm toward a horizontal center of said model train.

16. The model train of claim 15, further comprising a stabilizer connected to at least said frame, said stabilizer being configured to restrict horizontal movement of a portion of said elongated resilient structure, thereby increasing the resiliency of said elongated resilient structure relative to said pilot assembly.

17. A model train system, comprising:

a model train track;

a first model train configured to roll on said model train track, said first model train comprising a first coupler; and a second model train comprising:

a shell;

a frame connected to said shell;

at least one truck assembly pivotally attached to said frame, said at least one truck assembly comprising at least two wheels configured to roll on said model train track;

a pilot comprising a pilot assembly and a pilot arm, wherein said pilot assembly includes an aperture and is connected to said pilot arm, said pilot arm being pivotally attached to said frame; and a second coupler comprising a coupler assembly and a coupler arm, wherein said coupler assembly is connected to said coupler arm and is configured to link said second model train to said first model train via said first coupler, said coupler arm being positioned through said aperture of said pilot assembly and pivotally attached to said frame, thereby allowing said coupler arm to pivot horizontally a predetermined distance without coming into contact with a side of said aperture;

wherein said coupler arm is configured to pivot horizontally in response to at least said first model train moving over a curved portion of said model train track, and said pilot arm is configured to pivot in response to said coupler arm pivoting horizontally beyond said predetermined distance; and wherein said at least one truck assembly is attached to said frame via a first pivot, said pilot arm is attached to said frame via a second pivot and said coupler arm is attached to said frame via a third pivot.

18. A model train system, comprising:

a model train track;

a first model train configured to roll on said model train track, said first model train comprising a first coupler; and a second model train comprising:

a shell;

a frame connected to said shell;

at least one truck assembly pivotally attached to said frame, said at least one truck assembly comprising at least two wheels configured to roll on said model train track;

a pilot comprising a pilot assembly and a pilot arm, wherein said pilot assembly includes an aperture and is connected to said pilot arm, said pilot arm being pivotally attached to said frame; and a second coupler comprising a coupler assembly and a coupler arm, wherein said coupler assembly is connected to said coupler arm and is configured to link said second model train to said first model train via said first coupler, said coupler arm being positioned through said aperture of said pilot assembly and pivotally attached to said frame, thereby allowing said coupler arm to pivot horizontally a predetermined distance without coming into contact with a side of said aperture;

wherein said coupler arm is configured to pivot horizontally in response to at least said first model train moving over a curved portion of said model train track, and said pilot arm is configured to pivot in response to said coupler arm pivoting horizontally beyond said predetermined distance; and wherein said at least one truck assembly and said pivot arm are attached to said frame via a first pivot and said coupler arm is attached to said frame via a second pivot.

19. A model train system, comprising:

a model train track;

a first model train configured to roll on said model train track, said first model train comprising a first coupler; and a second model train comprising:

a shell;

a frame connected to said shell;

at least one truck assembly pivotally attached to said frame, said at least one truck assembly comprising at least two wheels configured to roll on said model train track;

a pilot comprising a pilot assembly and a pilot arm, wherein said pilot assembly includes an aperture and is connected to said pilot arm, said pilot arm being pivotally attached to said frame; and a second coupler comprising a coupler assembly and a coupler arm, wherein said coupler assembly is connected to said coupler arm and is configured to link said second model train to said first model train via said first coupler, said coupler arm being positioned through said aperture of said pilot assembly and pivotally attached to said frame, thereby allowing said coupler arm to pivot horizontally a predetermined distance without coming into contact with a side of said aperture;

wherein said coupler arm is configured to pivot horizontally in response to at least said first model train moving over a curved portion of said model train track, and said pilot arm is configured to pivot in response to said coupler arm pivoting horizontally beyond said predetermined distance; and wherein said at least one truck assembly and said coupler arm are attached to said frame via a first pivot and said pilot arm is attached to said frame via a second pivot.

20. A model train system, comprising:

a model train track;

a first model train configured to roll on said model train track, said first model train comprising a first coupler; and a second model train comprising:

a shell;

a frame connected to said shell;

at least one truck assembly pivotally attached to said frame, said at least one truck assembly comprising at least two wheels configured to roll on said model train track;

a pilot comprising a pilot assembly and a pilot arm, wherein said pilot assembly includes an aperture and is connected to said pilot arm, said pilot arm being pivotally attached to said frame; and a second coupler comprising a coupler assembly and a coupler arm, wherein said coupler assembly is connected to said coupler arm and is configured to link said second model train to said first model train via said first coupler, said coupler arm being positioned through said aperture of said pilot assembly and pivotally attached to said frame, thereby allowing said coupler arm to pivot horizontally a predetermined distance without coming into contact with a side of said aperture;

wherein said coupler arm is configured to pivot horizontally in response to at least said first model train moving over a curved portion of said model train track, and said pilot arm is configured to pivot in response to said coupler arm pivoting horizontally beyond said predetermined distance; and wherein said at least one truck assembly, said pivot arm and said coupler arm are attached to said frame via a first pivot.

* * * * *